United States Patent [19]

Heinzle

[11] Patent Number: 4,874,150

[45] Date of Patent: Oct. 17, 1989

[54] SEGMENTAL FORMWORK FOR ROUND STRUCTURES

[75] Inventor: Otto Heinzle, Montlingen, Switzerland

[73] Assignee: Jugo-Import-Export-Anstalt, Furstentum, Liechtenstein

[21] Appl. No.: 923,787

[22] PCT Filed: Jan. 24, 1986

[86] PCT No.: PCT/EP86/00028

§ 371 Date: Nov. 4, 1986

§ 102(e) Date: Nov. 4, 1986

[87] PCT Pub. No.: WO86/04378

PCT Pub. Date: Jul. 31, 1986

[30] Foreign Application Priority Data

Jan. 24, 1985 [AT] Austria ..... 190/85

[51] Int. Cl.[4] ..... E04G 11/20

[52] U.S. Cl. ..... 249/18; 249/20; 249/45; 249/48; 249/144; 249/153; 249/191; 249/192; 249/194

[58] Field of Search ..... 249/13, 17, 18, 19, 249/20, 21, 33, 40, 44, 45, 47, 189, 191, 192, 194–196, 213, 219 R, 219 W, 144, 153, 48

[56] References Cited

U.S. PATENT DOCUMENTS

| | | | |
|---|---|---|---|
| 1,327,481 | 1/1920 | Kulow | 249/20 |
| 2,885,762 | 5/1959 | Johanssan | 249/20 |
| 4,185,805 | 1/1980 | Ewing | 249/219 R |
| 4,540,150 | 9/1985 | Tzincoca | 249/20 |
| 4,557,090 | 12/1985 | Keller, Sr. | 52/732 |

FOREIGN PATENT DOCUMENTS

| | | | |
|---|---|---|---|
| 1784289 | 9/1971 | Fed. Rep. of Germany . | |
| 412798 | 7/1910 | France . | |
| 1011770 | 6/1949 | France . | |
| 8400189 | 1/1984 | Int'l Pat. Institute | 249/20 |
| 150988 | 7/1921 | United Kingdom . | |
| 1520259 | 8/1978 | United Kingdom . | |

*Primary Examiner*—Jay H. Woo
*Assistant Examiner*—James C. Housel
*Attorney, Agent, or Firm*—Toren, McGeady & Associates

[57] ABSTRACT

A segmental formwork for round structures has a framework consisting of soldiers (6) and polygonal stretchers (5) that can be adjusted angularly at the corner points. The formwork boards (12) of the formwork shell bear directly against the stretchers (5) and have a continuous curvature. The stretchers (5) are formed from structural shapes.

8 Claims, 3 Drawing Sheets

SEGMENTAL FORMWORK FOR ROUND STRUCTURES

The invention relates to a segmental formwork for round structures, having a framework with soldiers and stretchers and formwork panels that are attached pointwise thereto, the stretchers being polygonal and angularly adjustable.

Especially in the case of round structures with a very large diameter, not the whole wall is clamped with boards at one go, but wall sections, so-called segments, are clamped with boards, then filled with concrete. After such a wall section has been covered with concrete, the formwork is removed and an adjoining wall section is covered with concrete.

In a prior art segmental framework of this kind, the stretchers are formed from articulated counter battens that are fixed to vertical sections forming the soliders. The vertical sections support the formwork shell and furthermore the binding-through occurs in each case from an internal to an external articulated counter batten.

Admittedly, because of the shape of the stretchers, formwork segments of this kind can be adapted as articulated counter battens to different building diameters, but the formwork shell must be fully separated from the soldiers when the radius of curvature is changed. In addition, in many cases the soldiers of the internal and external formwork must be realigned to one another.

The invention has for its object the provision of a segmental formwork of the kind mentioned in the introduction, in which the radius of curvature can be changed without requiring the formwork panels of the formwork shell to be dismounted from the framework supporting them, i.e., from stretchers or soliders. This should be possible both in the case of an external and an internal formwork.

According to the invention, this can be achieved by making the stretchers bear directly against the formwork boards that have an at least substantially continuous curvature and by making the fixing points of the formwork boards on the framework slidable in the horizontal plane.

As a result of the design of the segmental formwork embodying the invention, the matching to different building diameters is greatly accelerated and facilitated.

Advantageously, provision is made that the stretchers have channel sections, L-beam sections or I-beam sections.

In contradistinction to conventional segmental formworks in which the soldiers and the stretchers bear sidewise against one another, whereby the soldiers are usually arranged between the stretchers and the formwork shell, provision is made in one embodiment of the invention that the soldiers are placed between the stretchers and are bonded thereto, preferably by welding.

Advantageously, in the case of an internal formwork the soldiers are arranged at the buckling points of the stretchers and, in the case of an external formwork, midway between the buckling points of the stretchers.

To facilitate the buildup of a relatively large formwork segment from several segmental rings, provision is advantageously made that the stretchers are arranged at the edges of the formwork boards and have projecting parts, so that, when the formwork panels are superposed on one another, the adjoining stretchers are locked through their shape.

In addition, provision is advantageously made that the formwork panels are secured to the soldiers, which have horizontal slots through which extend the retaining bolts or the like.

The resulting differences arising in the length of the formwork shell can be compensated by adding or removing secondary reinforcements that can be interposed between the formwork shell or between the soldiers. In another provision, gripping jaws are clamped onto the stretchers, preferably onto those that are located in the upper edge of the formwork panels; bind-through rods act on these gripping jaws. These gripping jaws can slide along the sections of the stretchers, so that when the curvature of the shell is changed, the bind-through rods can be aligned in rapid and simple fashion to the new geometric center of the circles of curvature of the internal and external framework.

Advantageously, provision is made that superposed stretchers are preferably held against one another by keyed joints.

Advantageously, the formworks are made of laminated wood, because a continuous curvature can be obtained with such formwork panels, which can have the necessary rigidity, so that they need to abut only at certain points on the stretchers.

In another advantageous embodiment of the invention, provision is made that the stretchers and soldiers form a closed frame that supports various formwork panels and that can be joined to the same kind of frame.

A detailed description will now be given of an embodiment of the invention by way of non-limitative example, reference being had to the figures in the accompanying drawings. Likewise, the reference symbols given in the claims below do not imply a restriction, they merely serve to facilitate the finding of the parts in question in the figures of the drawing.

Figure 1:
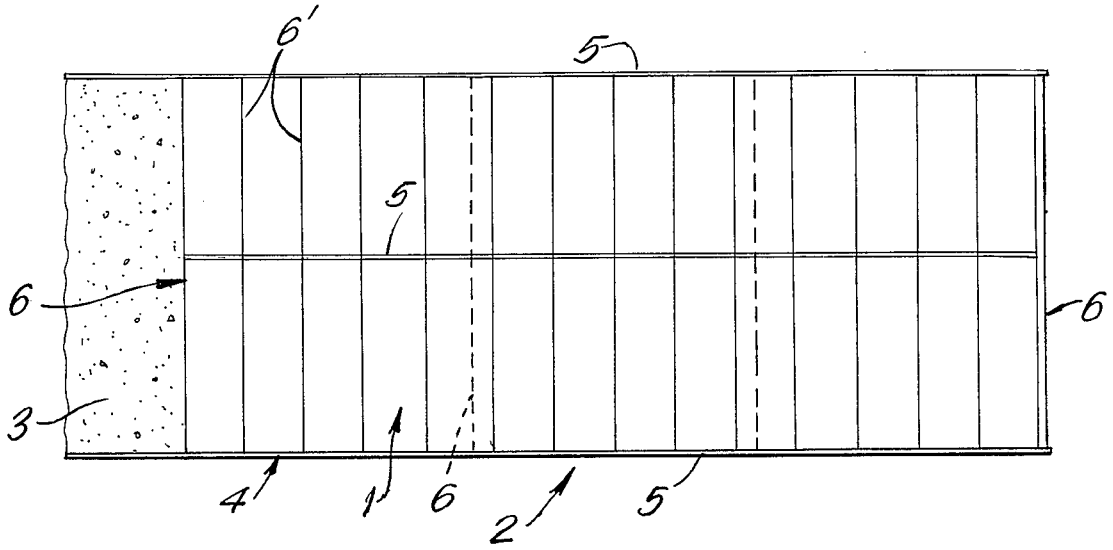
FIG. 1 is a schematic view of a segmental formwork incorporating the invention.

As can be seen in FIG. 1, various segmental formworks 1 can be combined into one large segment 2. In FIG. 1, a section that has already been filled with concrete is denoted by 3.

Each segmental formwork 1 has a closed frame 4 which is formed from stretchers 5 and soldiers 6.

While the stretchers 5 are shown as continuous, the soldiers 6 are formed from soldier sections 6', which are each interposed between two stretchers 5 and are joined thereto, preferably by welding.

Figure 2:
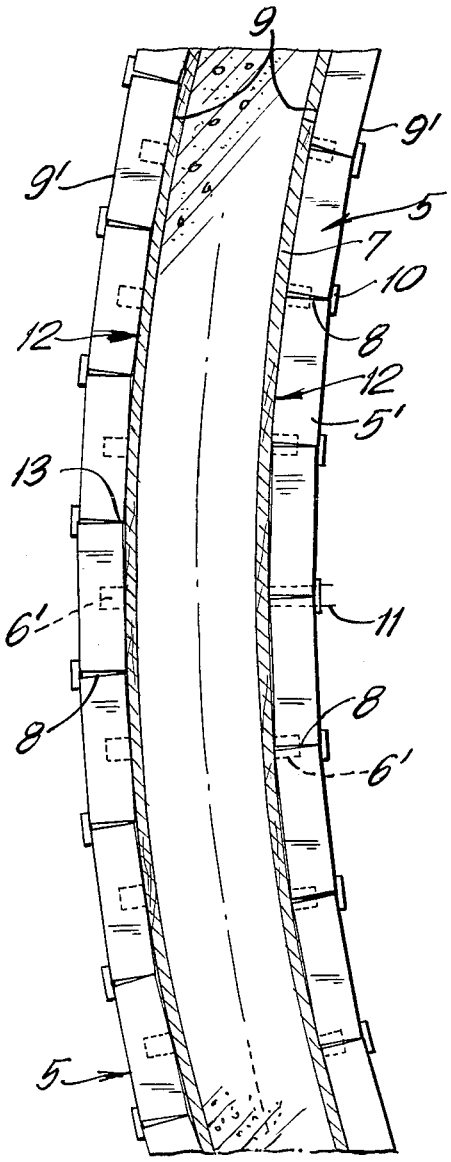
FIG. 2 is a horizontal section through the segmental formwork of the invention.
Figure 3:
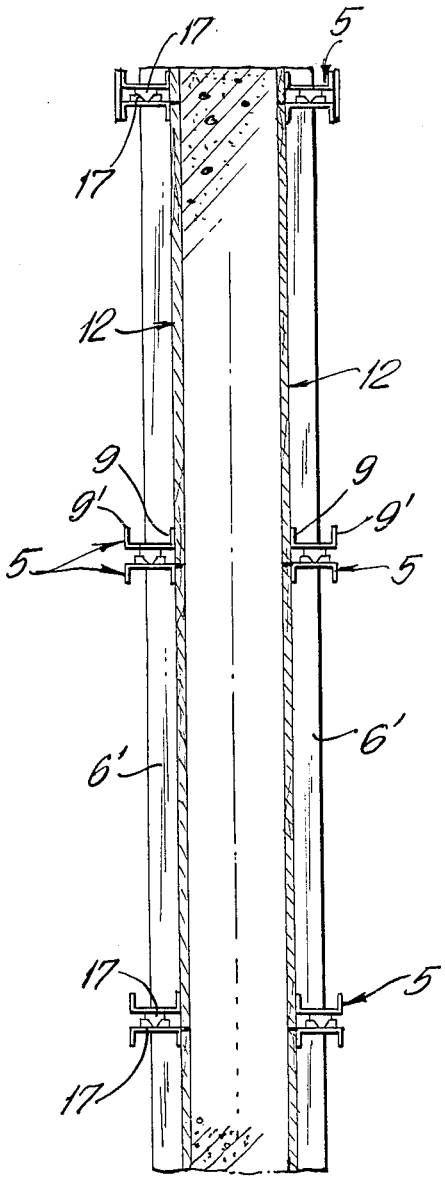
FIG. 3 is a vertical section.

The stretchers 5 are formed from structural shapes as shown in FIGS. 2 and 3. In the specific embodiment, they are channel sections. At their buckling points 8, the structural shapes are provided with slots, whereby the inner flange 9 of the section facing the formwork is not cut. In the opposite flange 9' there are provided side plates 10 or the like which connect the adjoining flange or bar sections 9' together. For example, the side plates 10 are provided with slots through which extend the retaining bolts 11. Thus, the curvature run of the stretchers 5 can be adjusted in simple fashion by loosening the retaining bolts 11 at the buckling points, whereupon the stretchers 5 are bent at the buckling points 8 and adapted to the desired curvature run. Subsequently, the set screws are tightened anew.

As can be seen in FIGS. 2 and 3, the formwork boards generally designated 12 bear directly against the stretchers 5 and against the soldiers 6.

Figure 5:
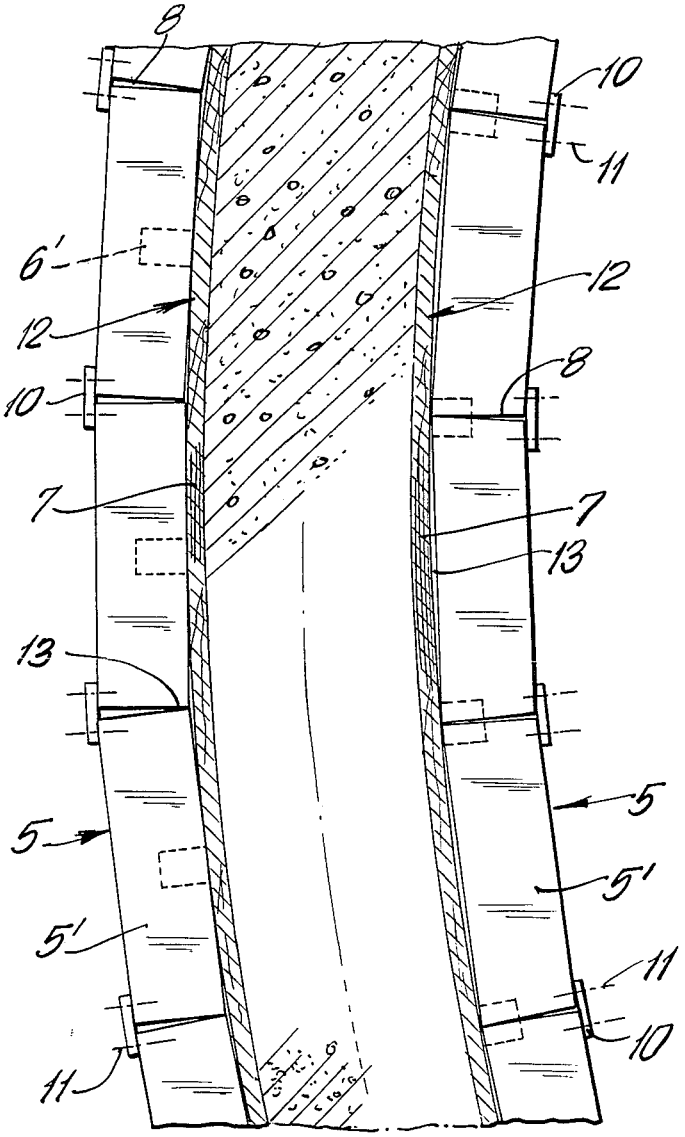
FIG. 5 is an enlarged cut-out from FIG. 2.

However, while the stretchers 5 are polygonal, the formwork boards 12 have a continuous curvature, so that free areas 13 are obtained between the stretchers 5 and the formwork boards 12 at locations intermediate the soldiers as best shown in FIG. 5.

The formwork boards 12 are composed of laminated wood 7 and may be covered with sheet metal on the concrete (inner) side. These formwork boards 12 can easily be bent on one side and have adequate rigidity and stress properties on the other side so as not to be pushed in such a way against the stretchers 5 by the freshly poured concrete that a polygonal formwork surface would result.

As apparent from FIG. 2, the soldiers 6 in the case of the internal formwork are arranged at the buckling points 8, but are in each case welded with only one stretcher section 5'. The stretchers 5 of the external formwork are placed midway between the buckling points. The formwork panels 12 are attached directly to the soldiers 6, which have horizontal slots through which extend the retaining bolts of the formwork panels 12. These retaining bolts can be moved within the slots, so that the formwork panels 12 must be dismounted when the curvature of the stretchers 5 is changed.

Figure 4:
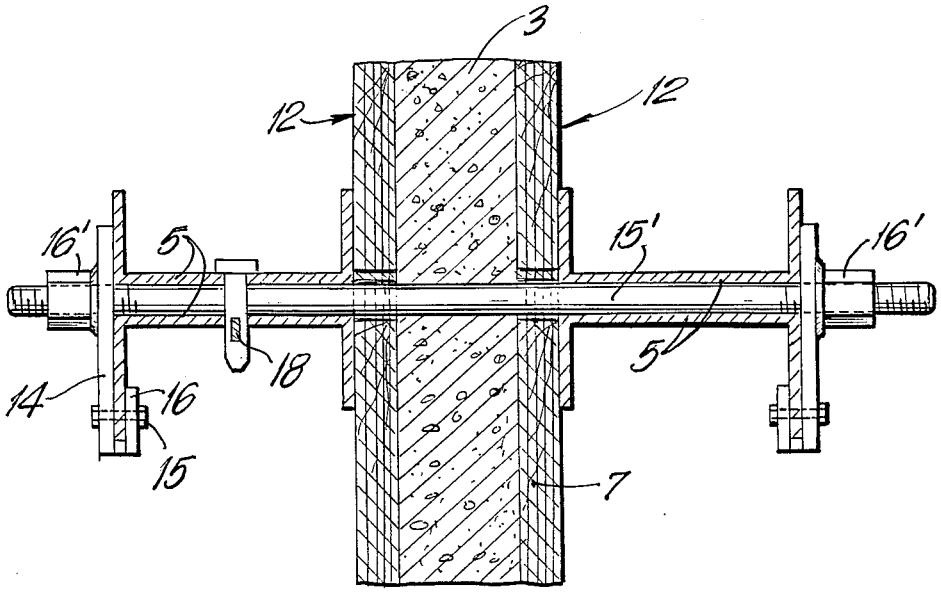
FIG. 4 is also a vertical section in the area where two superposed formwork rings are joined.

As can be seen in FIG. 4, gripping jaws 14 are held against the stretchers 5 by means of set screws 15 and friction pawls 16. The bind-through rods 15' are anchored in the gripping jaws 14. The bind-through rods 15' are screwed into nuts 16', which are capable of being removably secured to one side, e.g., in the case of the internal formwork, to the gripping jaw 14, thus practically forming a female thread of the gripping jaw 14 concerned. The insertion and screwing of the bind-through rods 15' can therefore be effected from one side of the formwork. In the practical example shown in FIG. 4, the bind-through rods 15' are pushed through the formwork from the right and screwed into the left nut 16' bolted with the gripping jaw 14. The right nut 16' is then screwed thereonto.

As apparent from FIG. 3, the stretchers 5, each of which is placed at the edges of the formwork panels 12, have projecting parts 17 that mesh with one another. Therefore, a formwork ring can easily be mounted on the other ring, during which process it is centered automatically. This facilitates the creeping of the formwork.

In the practical example, the soldier sections 6' are formed by square tubes, but I-beam sections or channel sections may also be employed.

Advantageously, concrete is poured with the segmental formwork of the invention, in such a way that a large segment 2 is built up, for example, in the case of the internal formwork. In the case of the external formwork, an annular section is set up with a height of preferably 1.5 m and connected to the internal formwork by means of the bind-through rods 15'. The reinforcement can be placed in full height beforehand.

Subsequently, the formed section is filled with concrete and compressed. Then, on the external formwork a second formwork ring can be placed on the preceding one. Again, this formwork ring is joined to the internal formwork and the pouring of concrete is repeated. When setting up the formwork rings, the advantage of the projecting parts 17 becomes evident, because the stretchers 5, and thereby the formwork panels 12 of adjoining formwork rings, are automatically aligned to one another.

The adjoining stretchers 5 of neighboring formwork rings or formwork panels 12 are advantageously connected together by wedged mortise and tenon joints 18.

The segmental formwork incorporating the invention makes possible a very rapid joining of individual formwork segments 1 and thus a rapid creeping of the formwork, so that the method described above can be applied. Also, the design of the segmental formwork incorporating the invention makes it possible to adapt the same rapidly to variously large diameters of round structures.

I claim:

1. A segmental formwork for round structures, comprising:

an internal formwork having at least two vertically spaced polygonal stretchers with a plurality of buckling points (8) around each stretcher, a soldier fixed between said stretchers for each buckling point, and at least one formwork board being at least substantially continuously curved and being mounted for horizontal movement to each of said stretchers and each of said soldiers, said stretchers bearing directly against said at least one formwork board; and an external formwork spaced outwardly from said internal formwork and having at least two vertically spaced polygonal stretchers with a plurality of buckling points (8) around each stretcher, a soldier fixed between said stretchers for each buckling point, and at least one formwork board being at least substantially continuously curved and being mounted for horizontal movement to each of said stretchers and each of said soldiers, said stretchers bearing directly against said at least one formwork board;

each said soldier of said internal formwork being fixed between said stretchers of said internal formwork at a respective buckling point of said internal formwork, and said soldiers of said external formwork being fixed mid-way between said stretchers of said external formwork at intermediate locations of said stretchers between buckling points of said stretchers.

2. A segmental formwork according to claim 1, wherein the transverse cross-sectional shape of each stretcher is selected from the group consisting of a channel, L-beam and I-beam section, each stretcher having inner and outer portions, the buckling points for each stretcher comprising a slot in each stretcher between the inner and outer portion thereof, the inner portion of the stretchers of said external formwork being bent to form each polygonal stretcher and the outer portion of the stretchers of said internal framework being bent to form said polygonal stretchers.

3. A segmental formwork according to claim 2, including a plate connected across each buckling point slot of each stretcher, said plates being connected between outer portions of said stretchers of said external formwork and between inner portions of said stretchers of said internal formwork.

4. A segmental formwork according to claim 2, wherein said stretchers of said internal and external formworks are arranged at edges of said formwork boards for said internal and external formworks, said stretchers including projecting parts on each stretcher of each of said internal and external formworks for centrally interlocking with projecting parts of superposed respective internal and external formworks.

5. A segmental formwork according to claim 4, including a gripping jaw connected to each of the stretchers of said internal and external formworks which are at the upper edge of each of said formwork boards, and a plurality of bind-through rods connected between said gripping jaws of said stretchers of said internal and external formworks, above said stretchers and through the upper edge of said formwork boards for connecting said internal and external formworks to each other.

6. A segmental formwork according to claim 4, including a plurality of keyed joints connected between the upper stretchers of said internal and external formworks, and for connection with lower stretchers of superposed internal and external formworks, respectively.

7. A segment formwork according to claim 2, wherein each of said formwork boards comprises a laminated board with a sheet metal covering positioned on a side of said formwork board which is between said internal and external formworks.

8. A segmental formwork according to claim 2, including a plurality of formwork boards for each of said internal and external formworks.

* * * * *